United States Patent [19]

O'Donnell

[11] Patent Number: 4,967,682

[45] Date of Patent: Nov. 6, 1990

[54] STABILIZING SYSTEM FOR A BOAT

[76] Inventor: Kenneth P. O'Donnell, 1555 SW. 27 Ter., Ft. Lauderdale, Fla. 33312

[21] Appl. No.: 378,852

[22] Filed: Jul. 12, 1989

[51] Int. Cl.[5] ..... B63B 1/22

[52] U.S. Cl. ..... 114/286

[58] Field of Search ..... 114/283–287, 114/126

[56] References Cited

U.S. PATENT DOCUMENTS 3,391,667 7/1968 Bue ..... 114/285

3,577,948 5/1971 Frey ..... 114/286

4,261,278 4/1981 Gaudin ..... 114/286 X

*Primary Examiner*—Sherman Basinger

*Attorney, Agent, or Firm*—Oblon, Spivak, McClelland, Maier & Neustadt

[57] ABSTRACT

At least two trim tabs 12 are mounted on the transom 11 symmetrically on each side of the longitudinal axis of the hull 10. Each trim tab 12 includes a plate 15 mounted on at least two rocker arms 16 for pivotal movement relative to the transom 11 and two or more hydraulic actuators 20 and 21 for pivoting the plate 15 relative to the distal ends of the rocker arms 16.

44 Claims, 4 Drawing Sheets

STABILIZING SYSTEM FOR A BOAT

FIELD OF THE INVENTION

This invention relates to stabilizing systems for boats. In particular, it relates to a system comprising two or more trim tabs mounted on the transom of a boat.

SUMMARY OF THE INVENTION

A stabilizing system according to the invention comprises at least two trim tabs mounted on the transom of the boat symmetrically on either side of the longitudinal axis of the boat. Each trim tab comprises a plate mounted on at least two rocker arms for pivotal movement relative to the transom and means for pivoting the plate relative to the distal ends of the rocker arms.

GENERAL DISCUSSION OF THE INVENTION

The stabilizing system according to the invention is a mechanical device designed for the marine industry to combine in one device the functions of trim tabs and the functions of stabilizers. The stabilizing system enables two jobs to be done by one device instead of two jobs to be done by two separate devices. Moreover, with the stabilizing system according to the invention, the operator has a control over the ride that is normally better than the control over the ride provided by a combination of the other systems now commercially available.

The stabilizing system according to the invention is designed not only to create lift on the stern of almost any sized boat, thereby giving forward-to-aft (front-to-rear) level ride, but also to stabilize the boat port-to-starboard (left-to-right).

The stabilizing system according to the invention trims and stabilizes by the use of two or more double-hinged planing surfaces that are mounted on the transom, at least one on the port side of the keel and at least one on the starboard side of the keel. Each of the planing surfaces is equipped with two independently operated hydraulic actuators. One such hydraulic actuator functions as the port-to-starboard stabilizing actuator, while the other such hydraulic actuator functions as the forward-to-aft trimming actuator.

On a condition of port roll, the starboard side port-to-starboard hydraulic actuator extends, thereby causing the starboard planing surface to extend below the planing surface of the hull, toe first, creating a negative lift that causes the starboard side of the boat to roll to starboard. At the same time, the port side port-to-starboard hydraulic actuator retracts, thereby creating heel-down of the associated planing surface, creating positive lift and thereby causing the port side of the boat to be raised. Once the boat attains a horizontal attitude from port-to-starboard, the port-to-starboard hydraulic actuators reverse their actions, thereby bringing the planing surfaces to a neutral state. This action is controlled hydraulically by a "brain box" that has the ability to create an artificial horizon as a means of controlling the port-to-starboard hydraulic actuators for stabilization.

The forward-to-aft trimming hydraulic actuators control the heel of the planing surfaces, thereby controlling the forward-to-aft attitude of the boat.

It should be particularly noted that the degree of trimming forward-to-aft is independent of the amount of stabilization port-to-starboard. The trimming aspect is controlled by a switch that is preferably conveniently located in a piloting area (i.e., at the helm). The stabilizing aspect of the planing surfaces is adjusted in such a way from the helm as to give light stabilization for light sea conditions and heavy stabilization for heavy sea conditions.

So far this is known by the inventor, the concept of the stabilizing system according to the invention is non-existent at this time in the form of one individual mechanism functioning as both a port-to-starboard stabilizer and a forward-to-aft trimmer. That is, at this point in time, trim tabs do one function and stabilizers do the other function. The stabilizing system according to the invention combines the two aforementioned functions into one. The result is a much smoother ride and a ride that is much more controllable by the operator, as well as being much more efficient.

The stabilizing system according to the invention is preferably hydraulically actuated and is powerful enough to be used at the highest speeds contemplated for use by the boat. By combining a forward-to-aft level ride (trim tabs) with a port-to-starboard level ride (stabilizers), the stabilizing system according to the invention actually balances the overall level of the boat for a very smooth ride. Due to the location of the stabilizing system according to the invention, its functioning is intensified because the planing surfaces are fed by thrusts from the propellers, as opposed to eddied water from the hullsides, as is the case with currently manufactured stabilizers.

Another disadvantage of current stabilizers is that they cause drag which reduces the speed and efficiency of the vessel, as well as making the vessel extremely vulnerable to collision and/or grounding. Certain types of presently manufactured stabilizers do have the ability of being retracted when not in use, but at the cost of considerably more machinery and maintenance. The stabilizing system according to the invention, however, is not in danger of either collision or grounding whether or not the planing surfaces are in use, since the planing surfaces are fully protected by the keel and by the propellers.

Finally, drag is minimized due to the fact that the planing surfaces are only momentarily submerged to obtain appropriate action, as opposed to being continually submerged -- as are conventional fins.

DETAILED DESCRIPTION OF THE PRESENTLY PREFERRED EMBODIMENT

Figure 6:
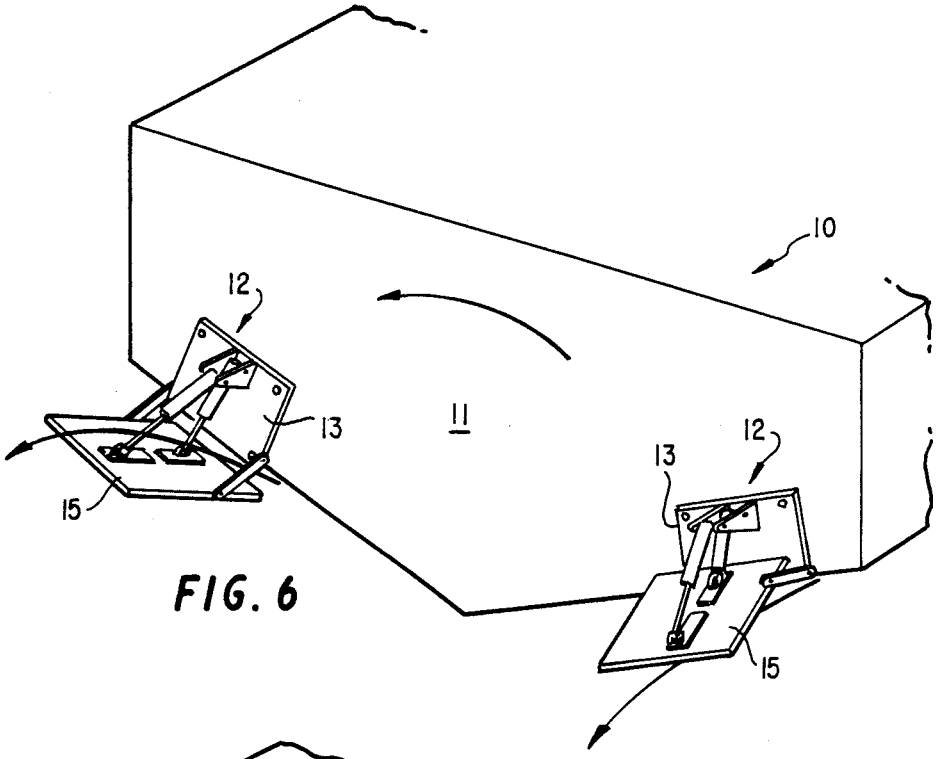
FIG. 6 is a perspective view of a stabilizing system according to the invention in position to counteract a roll toward the right.
Figure 7:
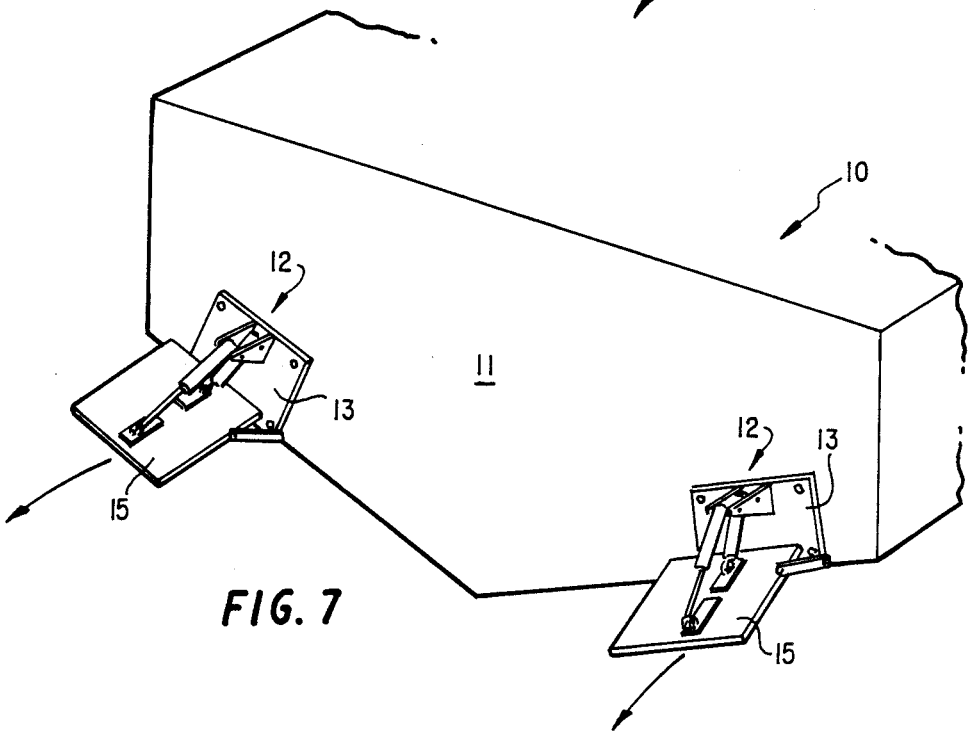
FIG. 7 is a perspective view of a stabilizing system according to the invention in position to bring down the bow of the boat.

Turning first to FIGS. 6 and 7, a hull 10 having a transom 11 will be seen. Two trim tabs 12 are symmetrically mounted on the transom 11 for use in counteracting rolls and in adjusting the yaw angle of the boat.

Figure 1:
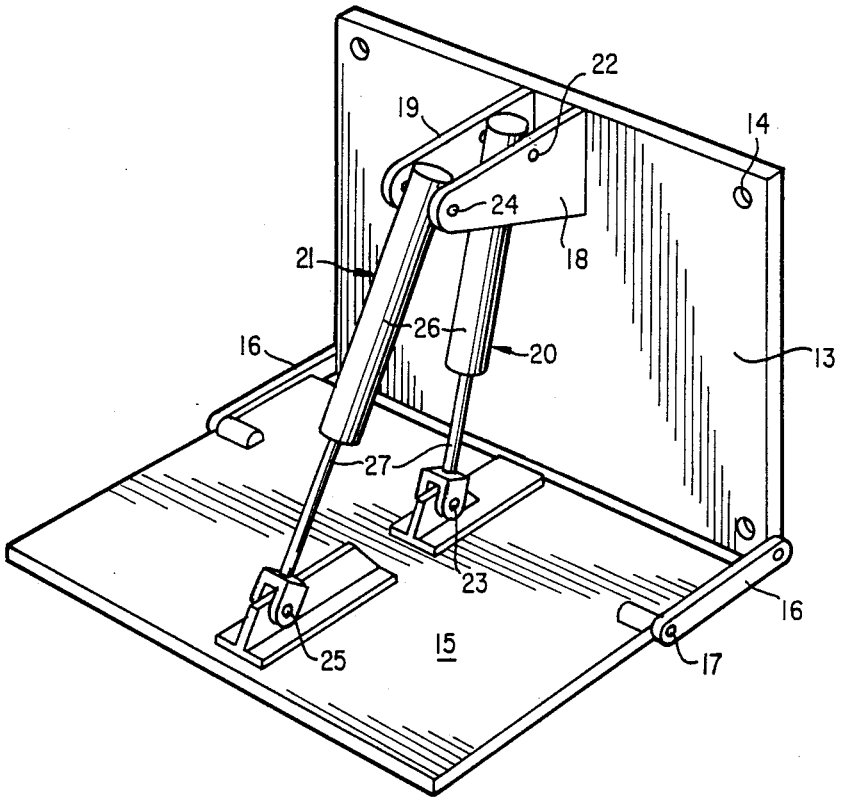
FIG. 1 is a perspective view of a trim tab according to the invention.
Figure 2:
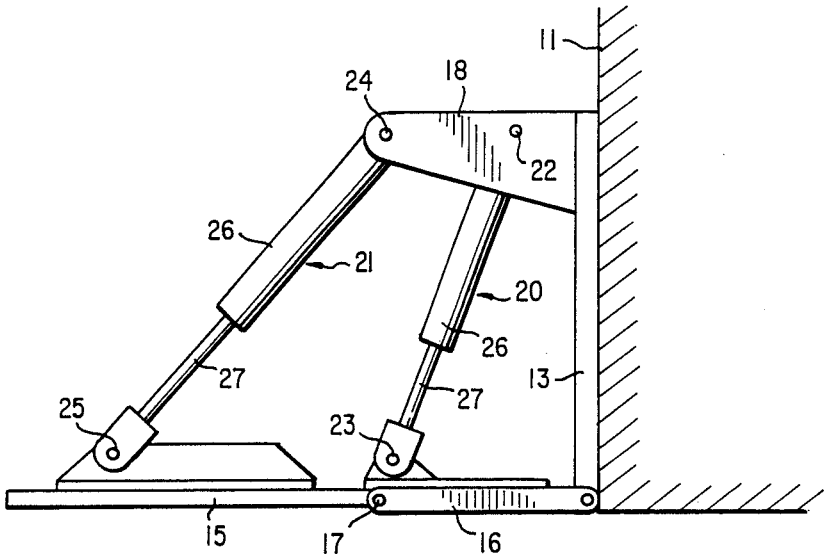
FIG. 2 is a side view of a trim tab according to the invention in its neutral position.
Figure 3:
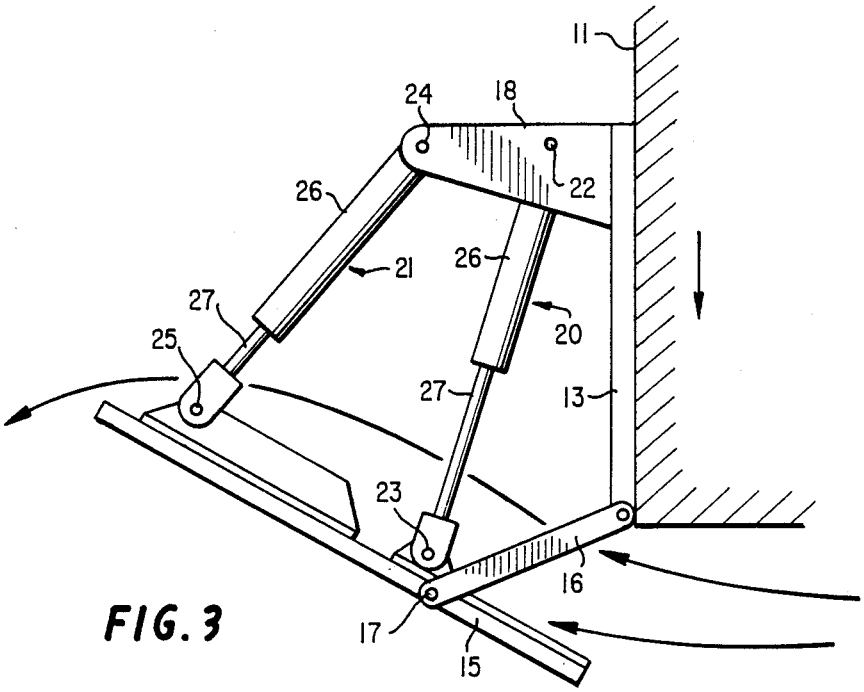
FIG. 3 is a side view of a trim tab according to the invention in position to bring down the stern of the boat.
Figure 4:
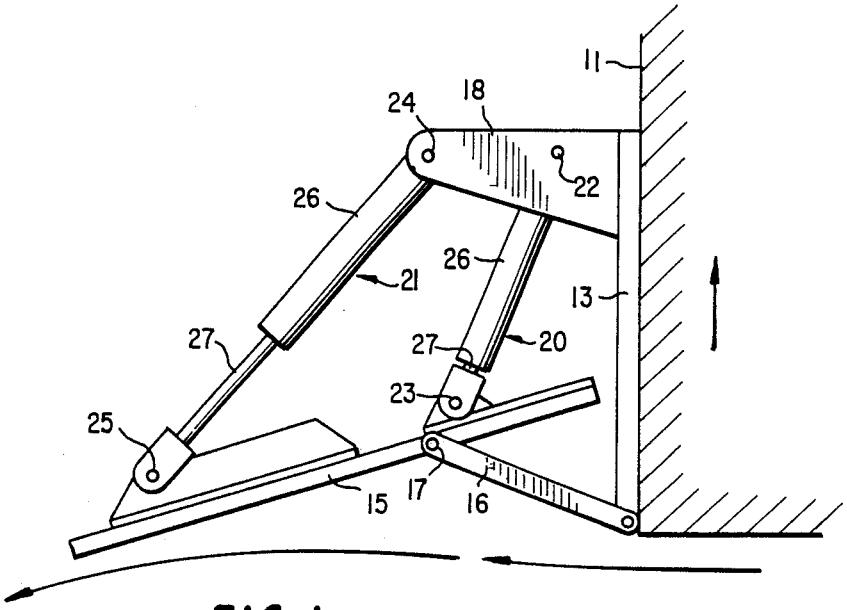
FIG. 4 is a side view of a trim tab according to the invention in position to bring up the stern of the boat by a first technique.
Figure 5:
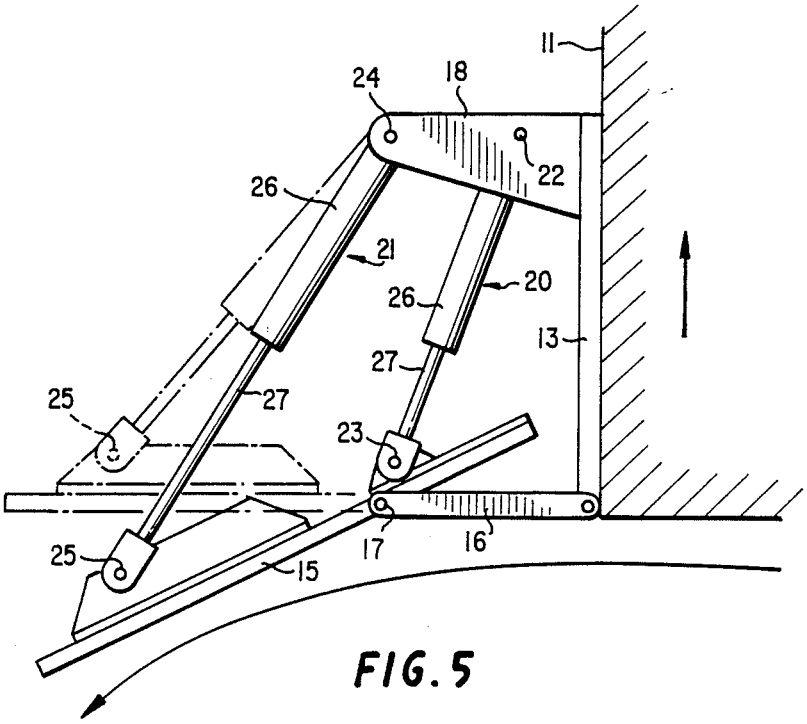
FIG. 5 is a side view of a trim tab according to the invention in position to bring up the stern of the boat by a second technique.

Preferably each trim tab 12 comprises a plate 13 that is adapted to be mounted on the transom 11 by means of bolt holes 14 (shown in FIG. 1) or the like. Preferably the plate 13 is rectangular in shape and has a top and a bottom. Alternatively, the remainder of each trim tab 12 can be mounted directly on the transom 11—that is, the plate 13 can be dispensed with.

A plate 15 is pivotally mounted on the plate 13 or the transom 11 by means of two rocker arms 16. Preferably the plate 15 is rectangular in shape and has a proximal side and a distal side. Each of the rocker arms 16 has a proximal end pivotally attached to the plate 13 or to the transom 11 and a distal end pivotally attached to the plate 15 at a first axis 17 intermediate its proximal and distal sides.

At least one mounting bracket projects from the plate 13 or the transom 11. Preferably first and second mounting brackets 18 and 19 project in parallel from the plate 13 or from the transom 11. First and second hydraulic actuators 20 and 21 are pivotally attached to the first and second mounting brackets 18 and 19 and to the plate 15. The first hydraulic actuator 20 has a first end pivotally mounted between the first and second mounting brackets 18 and 19 at a second axis 22 spaced from the plate 13 or from the transom 11 and a second end pivotally attached to the plate 15 at a third axis 23 spaced from its proximal side. The third axis 23 is preferably (but not necessarily) located inwardly from the first axis 17. The second hydraulic actuator 21 has a first end pivotally mounted between the first and second mounting brackets 18 and 19 at a fourth axis 24 spaced outwardly from the second axis 22 and a second end pivotally attached to the plate 15 at a fifth axis 25 spaced outwardly from the third axis 23.

Preferably the distance between the fourth axis 24 and the fifth axis 25 is greater than the distance between the second axis 22 and the third axis 23.

Also preferably each one of the first and second hydraulic actuators 20 and 21 comprises a cylinder (or dead-end) 26 pivotally attached to the first and second mounting brackets 18 and 19 and a piston rod (or live-end) 27 pivotally attached to the plate 15.

The position of the plate 15 is controlled by actuation of the first and second hydraulic actuators 20 and 21 as illustrated in the drawings under the control of an onboard computer. Since the control of trim tabs by such onboard computers is well known in the art and forms no part of this invention, it will not be described further herein.

Obviously, numerous modifications and variations of the present invention are possible in light of the above teachings. It is therefore to be understood that, within the scope of the appended claims, the invention may be practiced otherwise than as specifically described herein.

What is new and desired to be secured by Letters Patent of the United States is:

1. A stabilizer for a boat, said stabilizer comprising:

(a) a first plate having a proximal side and a distal side;

(b) a plurality of rocker arms, each one of said plurality of rocker arms having a proximal end pivotally attachable to the transom of a boat and a distal end pivotally attached to said first plate at a first axis intermediate its proximal and distal sides;

(c) a first mounting bracket projecting from the transom of the boat;

(d) a first hydraulic actuator having a first end pivotally attached to said first mounting bracket at a second axis spaced from the transom of the boat and a second end pivotally attached to said first plate at a third axis spaced from its proximal side; and (e) a second hydraulic actuator having a first end pivotally attached to said first mounting bracket at a fourth axis spaced outwardly from said second axis and a second end pivotally attached to said first plate at a fifth axis spaced outwardly from said third axis.

2. A stabilizer for a boat as recited in claim 1 and further comprising a second plate adapted to be mounted on the transom of a boat, said second plate having a top and a bottom, said first mounting bracket projecting from said second plate, and said plurality of rocker arms being pivotally attached to said second plate.

3. A stabilizer for a boat as recited in claim 2 wherein said first plate and said plurality of rocker arms are sized, shaped, and positioned so that, when said first plate is in a-neutral position, said proximal end of said first plate is spaced from said bottom of said second plate.

4. A stabilizer for a boat as recited in claim 2 wherein said second plate is rectangular in shape.

5. A stabilizer for a boat as recited in claim 1 wherein said first plate is rectangular in shape.

6. A stabilizer for a boat as recited in claim 5 wherein said first axis is parallel to said proximal side of said first plate.

7. A stabilizer for a boat as recited in claim 1 wherein said first axis is parallel to said proximal side of said first plate.

8. A stabilizer for a boat as recited in claim 1 wherein:

(a) said stabilizer further comprises a second mounting bracket projecting in parallel to said first mounting bracket and (b) said first and second hydraulic actuators are pivotally mounted between said first and second mounting brackets.

9. A stabilizer for a boat as recited in claim 1 wherein:

(a) each one of said first and second hydraulic actuators comprises a piston rod and a cylinder;

(b) said cylinder of each one of said first and second hydraulic actuators is pivotally attached to said first mounting bracket; and (c) said piston rod of each one of said first and second hydraulic actuators is pivotally attached to said first plate.

10. A stabilizer for a boat as recited in claim 1 wherein the distance between said fourth axis and said fifth axis is greater than the distance between said second axis and said third axis.

11. A stabilizer for a boat as recited in claim 1 wherein said third axis is located inwardly of said first axis.

12. A boat comprising:

(a) a hull having a transom and a longitudinal axis and (b) a plurality of trim tabs mounted on said transom on either side of said longitudinal axis, each one of said trim tabs comprising:
(i) a first plate having a proximal side and a distal side;
(ii) a plurality of rocker arms, each one of said plurality of rocker arms having a proximal end pivotally attached to said transom and a distal end pivotally attached to said first plate at a first axis intermediate its proximal and distal sides;
(iii) a first mounting bracket projecting from said transom;
(iv) a first hydraulic actuator having a first end pivotally attached to said first mounting bracket at a second axis spaced from said transom and a second end pivotally attached to said first plate at a third axis spaced from its proximal side; and
(v) a second hydraulic actuator having a first end pivotally attached to said first mounting bracket at a fourth axis spaced outwardly from said second axis and a second end pivotally attached to said first plate at a fifth axis spaced outwardly from said third axis.

13. A boat as recited in claim 12 wherein each one of said trim tabs further comprises a second plate mounted on said transom, said second plate having a top and a bottom, said first mounting bracket projecting from said second plate, and said plurality of rocker arms being pivotally attached to said second plate.

14. A boat as recited in claim 13 wherein said first plate and said plurality of rocker arms on each of said trim tabs are sized, shaped, and positioned so that, when said second plate is in a neutral position, said proximal end of said first plate is spaced from said bottom of said second plate.

15. A boat as recited in claim 13 wherein each of said second plates is rectangular in shape.

16. A stabilizer as recited in claim 12 wherein each of said first plates is rectangular in shape.

17. A boat as recited in claim 16 wherein said first axis in each of said trim tabs is parallel to said proximal side of said first plate.

18. A boat as recited in claim 12 wherein said first axis in each of said trim tabs is parallel to said proximal side of said first plate.

19. A boat as recited in claim 12 wherein:
(a) each one of said trim tabs further comprises a second mounting bracket projecting in parallel to said first mounting bracket and
(b) said first and second hydraulic actuators are pivotally mounted between said first and second mounting brackets.

20. A boat as recited in claim 12 wherein:
(a) each one of said first and second hydraulic actuators in each one of said trim tabs comprises a piston rod and a cylinder;
(b) said cylinder of each one of said first and second hydraulic actuators is pivotally attached to said first mounting bracket; and
(c) said piston rod of each one of said first and second hydraulic actuators is pivotally attached to said first plate.

21. A boat as recited in claim 12 wherein the distance between said fourth axis and said fifth axis in each one of said trim tabs is greater than the distance between said second axis and said third axis.

22. A boat as recited in claim 12 wherein said third axis is located inwardly of said first axis.

23. A stabilizer for a boat, said stabilizer comprising:
(a) a first plate having a proximal side and a distal side;
(b) a plurality of rocker arms, each one of said plurality of rocker arms having a proximal end pivotally attachable to a second plate mounted on the transom of a boat adjacent its bottom and a distal end pivotally attached to said first plate at a first axis intermediate its proximal and distal sides;
(c) a first mounting bracket projecting from said second plate;
(d) a first hydraulic actuator having a first end pivotally attached to said first mounting bracket at a second axis spaced from said second plate and a second end pivotally attached to said first plate at a third axis spaced from its proximal side; and
(e) a second hydraulic actuator having a first end pivotally attached to said first mounting bracket at a fourth axis spaced outwardly from said second axis and a second end pivotally attached to said first plate at a fifth axis spaced outwardly from said third axis.

24. A stabilizer for a boat as recited in claim 23 wherein said second plate has a top and a bottom, said first mounting bracket projects from said second plate, and said plurality of rocker arms is pivotally attached to said second plate.

25. A stabilizer for a boat as recited in claim 24 wherein said first plate and said plurality of rocker arms are sized, shaped, and positioned so that, when said first plate is in a neutral position, said proximal end of said first plate is spaced from said bottom of said plate.

26. A stabilizer for a boat as recited in claim 24 wherein said second plate is rectangular in shape.

27. A stabilizer for a boat as recited in claim 23 wherein said first plate is rectangular in shape.

28. A stabilizer for a boat as recited in claim 27 wherein said first axis is parallel to said proximal side of said first plate.

29. A stabilizer for a boat as recited in claim 23 wherein said first axis is parallel to said proximal side of said first plate.

30. A stabilizer for a boat as recited in claim 23 wherein:
(a) said stabilizer further comprises a second mounting bracket projecting in parallel to said first mounting bracket and
(b) said first and second hydraulic actuators are pivotally mounted between said first and second mounting brackets.

31. A stabilizer for a boat as recited in claim 23 wherein:
(a) each one of said first and second hydraulic actuators comprises a piston rod and a cylinder;
(b) said cylinder of each one of said first and second hydraulic actuators is pivotally attached to said first mounting bracket; and
(c) said piston rod of each one of said first and second hydraulic actuators is pivotally attached to said first plate.

32. A stabilizer for a boat as recited in claim 23 wherein the distance between said fourth axis and said fifth axis is greater than the distance between said second axis and said third axis.

33. A stabilizer for a boat as recited in claim 23 wherein said third axis is located inwardly of said first axis.

34. A boat comprising:

(a) a hull having a transom and a longitudinal axis and
(b) a plurality of trim tabs mounted on said transom on either side of said longitudinal axis, each one of said trim tabs comprising:
(i) a first plate having a proximal side and a distal side;
(ii) a plurality of rocker arms, each one of said plurality of rocker arms having a proximal end pivotally attached to a second plate mounted on said transom adjacent its bottom and a distal end pivotally attached to said first plate at a first axis intermediate its proximal and distal sides;
(iii) a first mounting bracket projecting from said second plate;
(iv) a first hydraulic actuator having a first end pivotally attached to said first mounting bracket at a second axis spaced from said second plate and a second end pivotally attached to said first plate at a third axis spaced from its proximal side; and
(v) a second hydraulic actuator having a first end pivotally attached to said first mounting bracket at a fourth axis spaced outwardly from said second axis and a second end pivotally attached to said first plate at a fifth axis spaced outwardly from said third axis.

35. A boat as recited in claim 34 wherein said second plate has a top and a bottom, said first mounting bracket projects from said second plate, and said plurality of rocker arms is pivotally attached to said second plate.

36. A boat as recited in claim 35 wherein said first plate and said plurality of rocker arms on each of said trim tabs are sized, shaped, and positioned so that, when said second plate is in a neutral position, said proximal end of said first plate is spaced from said bottom of said second plate.

37. A boat as recited in claim 35 wherein each of said second plates is rectangular in shape.

38. A stabilizer as recited in claim 34 wherein each of said first plates is rectangular in shape.

39. A boat as recited in claim 38 wherein said first axis in each of said trim tabs is parallel to said proximal side of said first plate.

40. A boat as recited in claim 34 wherein said first axis in each of said trim tabs is parallel to said proximal side of said first plate.

41. A boat as recited in claim 34 wherein:
(a) each one of said trim tabs further comprises a second mounting bracket projecting in parallel to said first mounting bracket and
(b) said first and second hydraulic actuators are pivotally mounted between said first and second mounting brackets.

42. A boat as recited in claim 34 wherein:
(a) each one of said first and second hydraulic actuators in each one of said trim tabs comprises a piston rod and a cylinder;
(b) said cylinder of each one of first and second hydraulic actuators is pivotally attached to said first mounting bracket; and
(c) said piston rod of each one of said first and second hydraulic actuators is pivotally attached to said first plate.

43. A boat as recited in claim 34 wherein the distance between said fourth axis and said fifth axis in each one of said trim tabs is greater than the distance between said second axis and said third axis.

44. A boat as recited in claim 34 wherein said third axis is located inwardly of said first axis.

* * * * *